US008074820B2

(12) United States Patent
Chu

(10) Patent No.: US 8,074,820 B2
(45) Date of Patent: Dec. 13, 2011

(54) WALL PANEL AFFIXING ARRANGEMENT FOR PORTABLE WORK AND STORAGE CONTAINER

(76) Inventor: Terry Chu, Chino Hills, CA (US)

( * ) Notice: Subject to any disclaimer, the term of this patent is extended or adjusted under 35 U.S.C. 154(b) by 620 days.

(21) Appl. No.: 12/228,746

(22) Filed: Aug. 15, 2008

(65) Prior Publication Data

US 2010/0039005 A1 Feb. 18, 2010

(51) Int. Cl.
*B65D 6/28* (2006.01)
*B65D 88/00* (2006.01)

(52) U.S. Cl. ..... 220/4.33; 220/1.5; 220/682

(58) Field of Classification Search ..... 220/4.34, 220/4.33, 693, 692, 677, 4.01; 217/13, 17, 217/45, 43 R; 206/600; 52/127.7; *B65D 88/00, B65D 6/28*

See application file for complete search history.

(56) References Cited

U.S. PATENT DOCUMENTS 666,797 A * 1/1901 Breault ..... 217/65
1,636,458 A * 7/1927 Cheney ..... 217/66
2,628,737 A * 2/1953 Zeni ..... 217/12 R
2,664,258 A * 12/1953 Lanier ..... 248/172
2,869,750 A * 1/1959 Doerr et al. ..... 220/4.28
2,919,826 A * 1/1960 Richter ..... 220/1.5
3,374,915 A * 3/1968 Verhein et al. ..... 220/4.28
3,401,814 A * 9/1968 Chiswell et al. ..... 220/4.33
3,587,900 A * 6/1971 Millar et al. ..... 217/12 R
3,727,785 A * 4/1973 Lutz ..... 217/12 R
4,221,515 A * 9/1980 Brown et al. ..... 410/32
4,287,997 A * 9/1981 Rolfe et al. ..... 220/1.5
4,625,880 A * 12/1986 Pym ..... 220/4.33
4,693,386 A * 9/1987 Hughes et al. ..... 220/1.5
6,109,469 A * 8/2000 Clive-Smith ..... 220/1.5
6,119,427 A * 9/2000 Wyman et al. ..... 52/584.1
2009/0032530 A1 * 2/2009 Chu ..... 220/4.28

* cited by examiner

*Primary Examiner* — Mickey Yu
*Assistant Examiner* — Robert J Hicks
(74) *Attorney, Agent, or Firm* — Raymond Y. Chan; David and Raymond Patent Firm

(57) ABSTRACT

A portable work and storage container includes a container frame, an enclosure arrangement and a wall panel affixing arrangement. The container frame includes a ceiling frame, a floor frame and four vertical corner posts spacedly extended between the ceiling frame and the floor frame. The wall panel affixing arrangement includes a plurality of wall adjusters and a plurality of wall lockers, wherein every two of the wall adjusters are adjustably extended to bias against two outer side rims of the wall structure respectively for applying a pushing force so as to ensure the wall panels of each of the wall structure are coupled with each other side-by-side. The wall lockers are adjustably engaged with top rims of the wall structures respectively to lock up the wall structures between the ceiling frame and the floor frame so as to securely retain the wall.

31 Claims, 7 Drawing Sheets

WALL PANEL AFFIXING ARRANGEMENT FOR PORTABLE WORK AND STORAGE CONTAINER

BACKGROUND OF THE PRESENT INVENTION

1. Field of Invention

The present invention relates to a container, and more particularly to a portable work and storage container comprising a wall panel affixing arrangement which is capable of securely affix wall structures to respective container frames for enhancing the overall structural strength and stability of the container.

2. Description of Related Arts

Referring to FIG. 1A to FIG. 1B of the drawings, a conventional container usually comprises a container frame 10P, a plurality of enclosing panels 20P, and a panel fastening arrangement 30P. The container frame 10P usually comprises a plurality of supporting members 11P spacedly erected and supported to form a substantially rectangular enclosing skeleton of the container frame 10P. The enclosing panels 20P are affixed, through the panel fastening arrangement 30P, to the supporting members 11P so as to define a container cavity within the enclosing panels 20P, wherein the container cavity is adapted to support a wide range of activities such as being a temporary office, a storage room, and the likes. As shown in FIG. 1A and FIG. 1B of the drawings, each of the supporting members 11P is connected with one or more adjacent supporting members 11P to form the substantially rectangular structure for fastening the enclosing panels 20P.

Conventionally, each of the supporting members 11P has two member panels 111P integrally and perpendicularly extended from each other to define an L-shaped cross section of the corresponding supporting member 11P forming an engaging cavity 112P as the space between the two member panels 111P, wherein the corresponding enclosing panel 20P is arranged to fasten with the supporting member 11P at the engaging cavity 112P.

The panel fastening arrangement 30P contains a plurality of elongated engaging grooves 31P formed along side edges of the enclosing panels 20P, and comprises a plurality of L-shaped connecting members 32P affixed in the engaging cavities 112P of the supporting members 11P respectively, wherein each of the connecting members 32P has an engaging portion 321P adapted to insert into the elongated engaging groove 31P formed on the corresponding enclosing panel 20P so as to detachably connect the enclosing panel 20P with the corresponding supporting member(s) 11P. As shown in FIG. 1B of the drawings, each of the L-shaped connecting members 32P is affixed to the corresponding member panel 111P of the corresponding supporting member 11P through a conventional connector 33P, such as a screw.

Moreover, for each two enclosing panels 20P which are directly connected with each other for say, forming the sidewall or ceiling of the container, each of those enclosing panels 20P has an L-shaped inner side edge arranged to be biased against the inner side edge of the adjacent enclosing panel 20P for connecting the two enclosing panel 20P in a side-by-side manner.

Notwithstanding its usefulness, there are several disadvantages for the above-mentioned conventional container. First, the engagement between the enclosing panels 20P and the supporting members 11P are usually not strong and secure enough so that the enclosing panels 20P may have unwanted displacement with respective to the corresponding supporting member(s) 11P. This unwanted displacement usually takes the form of severe vibration, up-and-down movement and/or forward and backward movement with respective to the supporting member(s) 11P. When the magnitude of the displacement is too great, the enclosing panels 20P concerned is subject to a great magnitude of stress and susceptible to be broken.

Second, since there is substantial unwanted movement on the part of the enclosing panels 20P, the biasing force exerted to keep the two enclosing panels 20P together for the purpose of forming a gapless sidewall or ceiling of the container may not be adequate. As such, users of the conventional container may have to insert some sorts of "junk materials" (such as metallic, wooden or paper residuals) at two sides of the enclosing panels 20P to fill any gap between the supporting member 11P and the corresponding enclosing panel 20P (especially the gaps formed in the elongated engaging groove 31P).

SUMMARY OF THE PRESENT INVENTION

A main object of the present invention is to provide a portable work and storage container comprising a wall panel affixing arrangement which is capable of securely affix wall structures to respective container frames for enhancing the overall structural strength and stability of the container.

Another object of the present invention is to provide a portable work and storage container which comprises a plurality of wall adjusters adapted for applying a pushing force along a longitudinally planar direction of a wall structure of the container so as to ensure that wall panels of each of the wall structure are securely coupled with each other in a side-by-side manner without substantial unwanted movement.

Another object of the present invention is to provide a portable work and storage container wherein the enclosure arrangement is securely affixed with respective to the container frame so as to substantially prevent the likelihood of accidental breakage of the enclosure arrangement. In other words, the present invention enhances the safety of using a portable work and storage container.

Another object of the present invention is to provide a portable work and storage container which dose not involve expensive or complicated mechanical structures. As such, the manufacturing and handling cost of the present invention can be minimized.

Accordingly, the present invention provides a portable work and storage container, comprising:

a container frame which comprises a ceiling frame, a floor frame and four vertical corner posts spacedly extended between the ceiling frame and the floor frame;

an enclosure arrangement which comprises a ceiling panel mounting at the ceiling frame, a floor panel mounting at the floor frame, and four wall structures mounting to the corner posts, each of the wall structures comprises a plurality of wall panels mounting between every two neighboring corner posts edge-to-edge to define a compartment within the ceiling panel, the floor panel, and the wall structures; and a wall panel affixing arrangement, which comprises:

a plurality of wall adjusters spacedly coupled at the corner posts respectively, wherein every two of the wall adjusters are adjustably extended to bias against two outer side rims of the wall structure respectively for applying a pushing force along a longitudinally planar direction of the wall structure so as to ensure the wall panels of each of the wall structure are coupled with each other side-by-side; and a plurality of wall lockers spacedly coupled at the ceiling frame, wherein the wall lockers are adjustably engaged with top rims of the wall structures respectively to lock up the wall structures between the ceiling frame and the floor frame so as to securely retain the wall structures at a transversely planar direction.

These and other objectives, features, and advantages of the present invention will become apparent from the following detailed description, the accompanying drawings, and the appended claims.

DETAILED DESCRIPTION OF THE PREFERRED EMBODIMENT

Figure 1A:
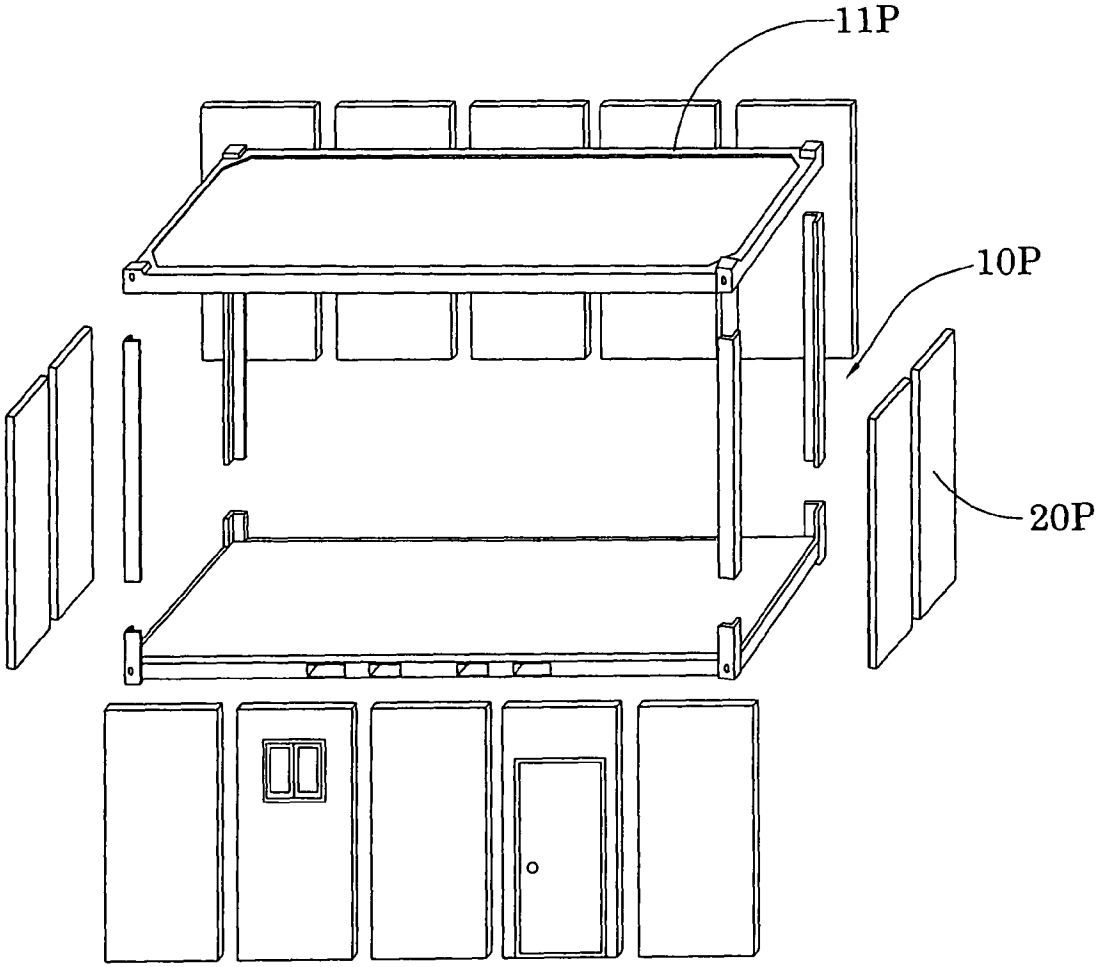
FIG.1A (PRIOR ART)
FIG. 1A is a perspective view of a conventional container.
Figure 1B:
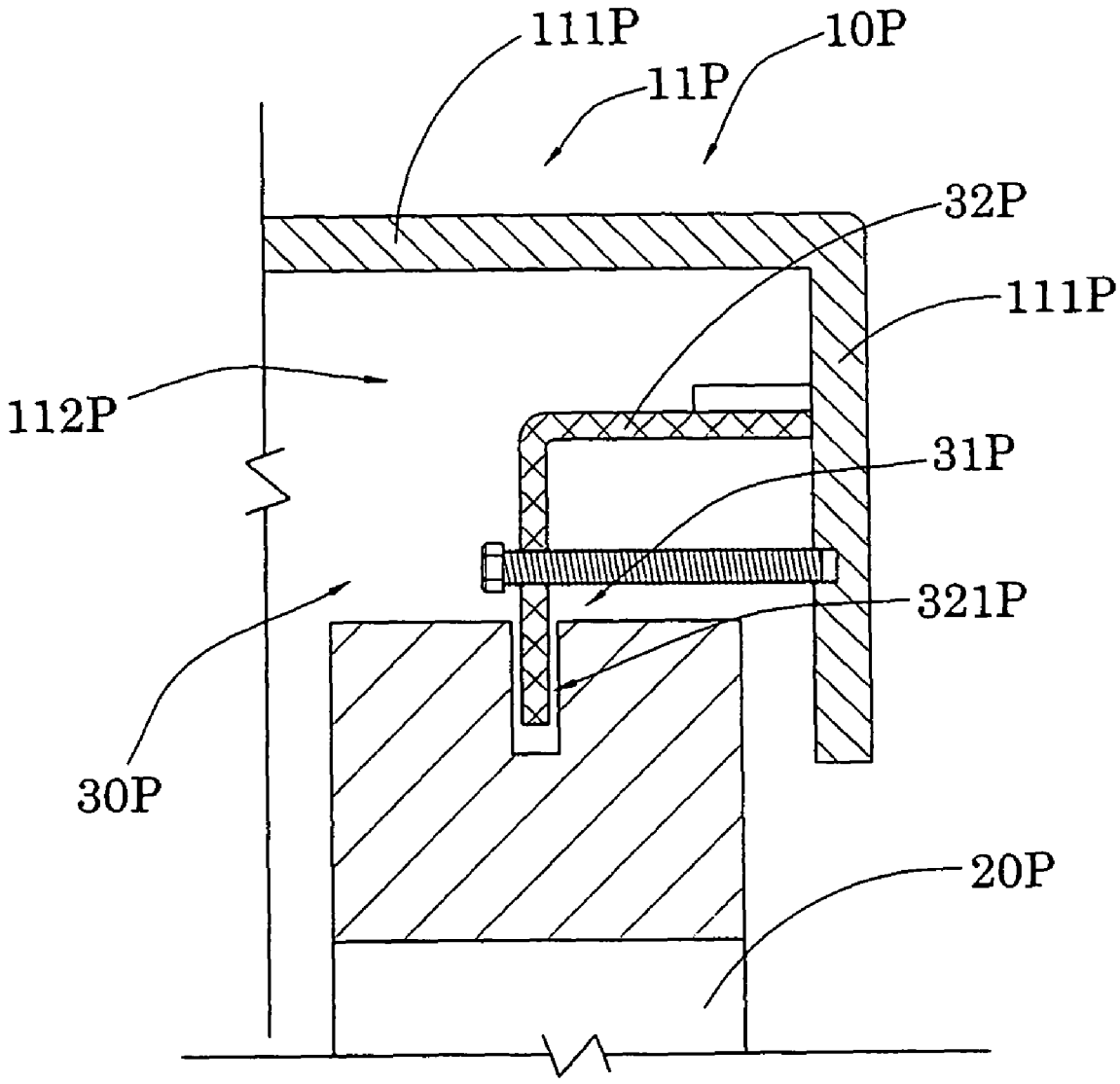
FIG.1B (PRIOR ART)
FIG. 1B is a sectional side view of the conventional container.
Figure 2:
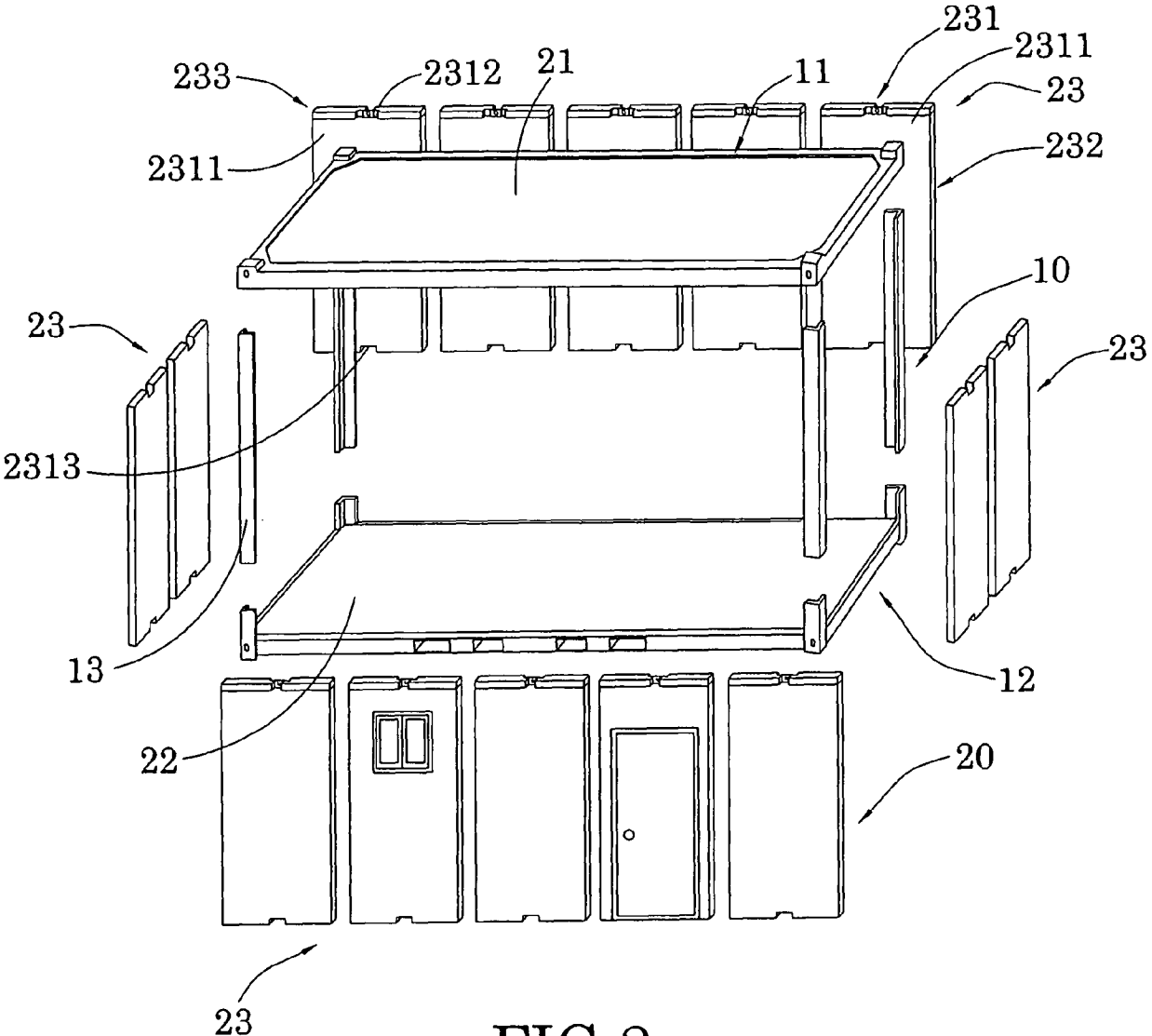
FIG. 2 is a perspective view of a portable work and storage container according to a preferred embodiment of the present invention.

Referring to FIG. 2 to FIG. 6 of the drawings, a portable work and storage container according to a preferred embodiment of the present invention is illustrated, in which the comprises a container frame 10, an enclosure arrangement 20, and a wall panel affixing arrangement 30.

The container frame 10 comprises a ceiling frame 11, a floor frame 12 and four vertical corner posts 13 spacedly extended between the ceiling frame 11 and the floor frame 12.

The enclosure arrangement 20 comprises a ceiling panel 21 mounting at the ceiling frame 11, a floor panel 22 mounting at the floor frame 12, and four wall structures 23 mounting to the corner posts 13, wherein each of the wall structures 23 comprises a plurality of wall panels 231 mounting between every two neighboring corner posts 13 in an edge-to-edge manner to define a compartment within the ceiling panel 21, the floor panel 22, and the wall structures 23.

The wall panel affixing arrangement 30 comprises a plurality of wall adjusters 31 and a plurality of wall lockers 32. The wall adjusters 31 are spacedly coupled at the corner posts 13 respectively, wherein every two of the wall adjusters 31 are adjustably extended to bias against two outer side rims 232 of the corresponding wall structure 23 respectively for applying a pushing force along a longitudinally planar direction of the corresponding wall structure 23 so as to ensure the wall panels 231 of each of the wall structure 23 are securely coupled with each other in a side-by-side manner.

On the other hand, the wall lockers 32 are spacedly coupled at the ceiling frame 11, wherein the wall lockers 32 are adjustably engaged with top rims of the wall structures 23 respectively to lock up the wall structures 23 between the ceiling frame 11 and the floor frame 12 so as to securely retain the wall structures 23 at a transversely planar direction with minimized lateral movement between the wall structures 23 and the container frame 10.

According to the preferred embodiment of the present invention, each of the wall panels 231 comprises a panel body 2311, a top brim 2312 extended along a top side of the panel body 2311, and a bottom brim 2313 extended along a bottom side of the panel body 2311, wherein a top rim 233 of the wall structure 23 is formed at the top brims 2312 of the panel bodies 2311 and extending in a side-by-side manner.

Each of the wall adjusters 31 comprises a retention panel 311 extended from the respective corner post 13 and an adjustable coupler 312 rotatably coupling with the retention panel 311 to press against the respective outer side rim 232 of the wall structure 23 at longitudinally planar direction thereof so as to ensure that each of the wall panels 231 biases against the adjacent wall panel 231 in an edge-to-edge manner for maintaining the overall structural integrity of the respective wall structure 23.

Accordingly, each of the adjustable couplers 312 has an enlarged head end 3121, an adjusting end 3122, and an elongated threaded body 3123 extended between the head end 3121 and the adjusting end 3122 and arranged in such a manner that when the threaded body 3123 is adjustably rotated at the retention panel 311, the head end 3121 is adjustably moved to press against the respective outer side rim 232 of the of the wall structure 23 for applying the pushing force thereat.

Moreover, each of the retention panel 311 has a L-shaped cross section, and a first retention portion 3111 extended from the respective corner post 13 to parallely extend with the respective wall structure 23, and a second retention portion 3112 perpendicularly extended from the first retention portion 3111 to align with the respective outer side rim 232 of the wall structure 23, wherein the adjustable coupler 312 is rotatably coupled with the second retention portion 3112 to press against the respective outer side rim 232 of the respective wall structure 23 at longitudinally planar direction thereof so as to securely retain the wall panels 231 basing against each other in the side-by-side manner.

Figure 5:
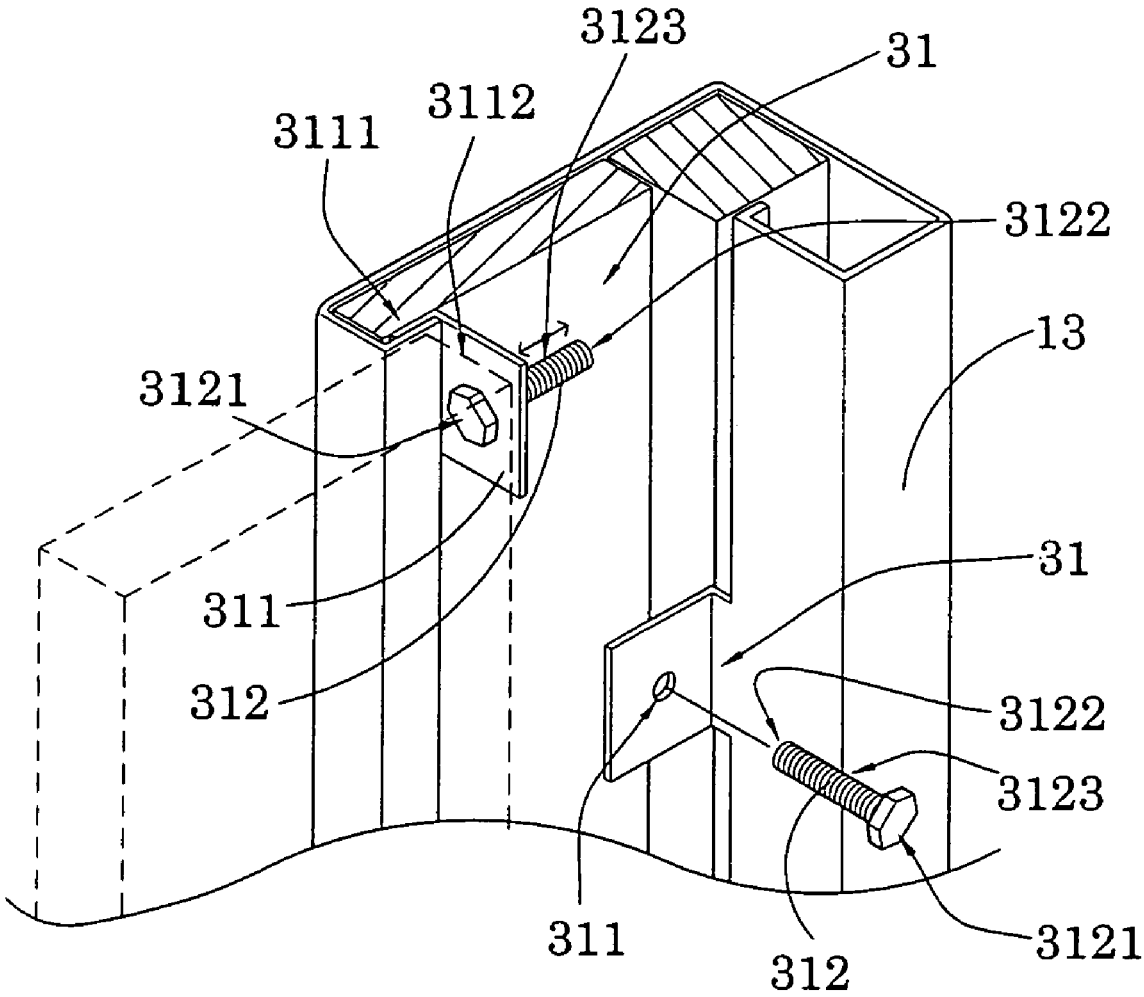
FIG. 5 is a schematic diagram of the portable work and storage container according to the above preferred embodiment of the present invention.
Figure 6:
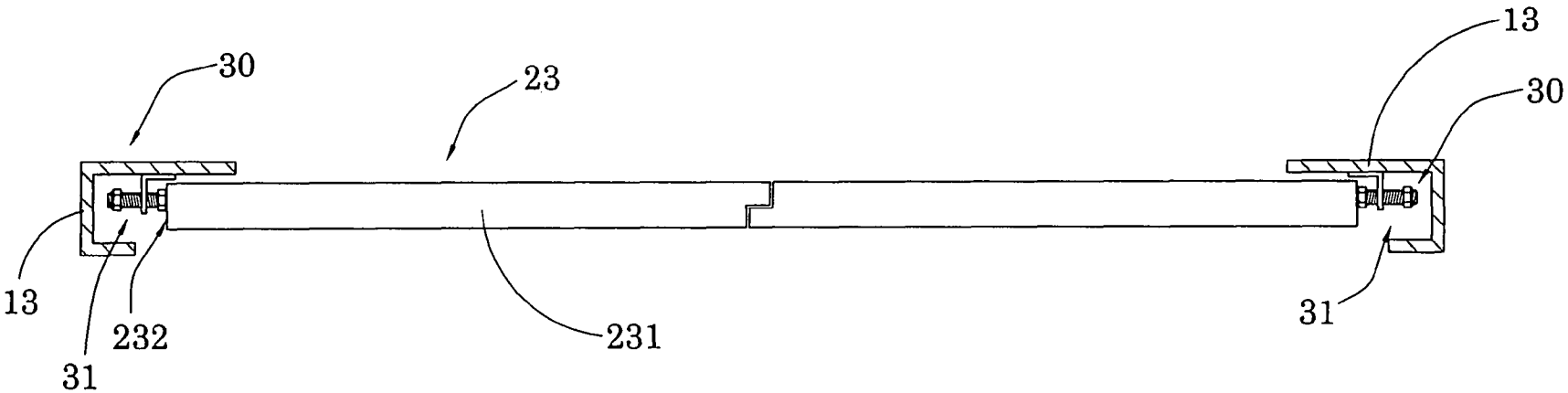
FIG. 6 is a top view of the portable work and storage container according to the above preferred embodiment of the present invention, illustrating the connection between two wall panels.

As shown in FIG. 5 of the drawings, the second retention portion 3112 of each of the retention panels 311 has a threaded hole 3113 rotatably engaging with the threaded body 3123 of the respective adjustable coupler 312 to retain the adjustable coupler 312 perpendicularly to the second retention portion 3112 of the retention panel 311 in a rotatably movable manner, such that when the adjustable coupler 312 is rotatably moved to bias against the outer side rim 232 of the corresponding wall structure 23, the corresponding wall panel 231 is pushed towards the planer direction thereof for strongly yet optimally biasing against the adjacent wall panel 231.

It is worth mentioning that since the adjustable coupler 312 is adapted to move with respective to the retention panel 311 in a well-controlled and adjustable manner, there is no need for the user of the present invention to insert anything within the gap between the wall structures 23 and the container frame 10 for restricting any collateral movement of the wall structures 23.

Furthermore, each of the corner posts 13 has an L-shape structure as a wall converge for retaining two of the intersecting wall structures 23 in a perpendicular manner, wherein two or more of the wall adjusters 31 are provided at each of the corner posts 13 to adjustably engage with the outer side rims 232 of the two intersecting wall structures 23.

Figure 3:
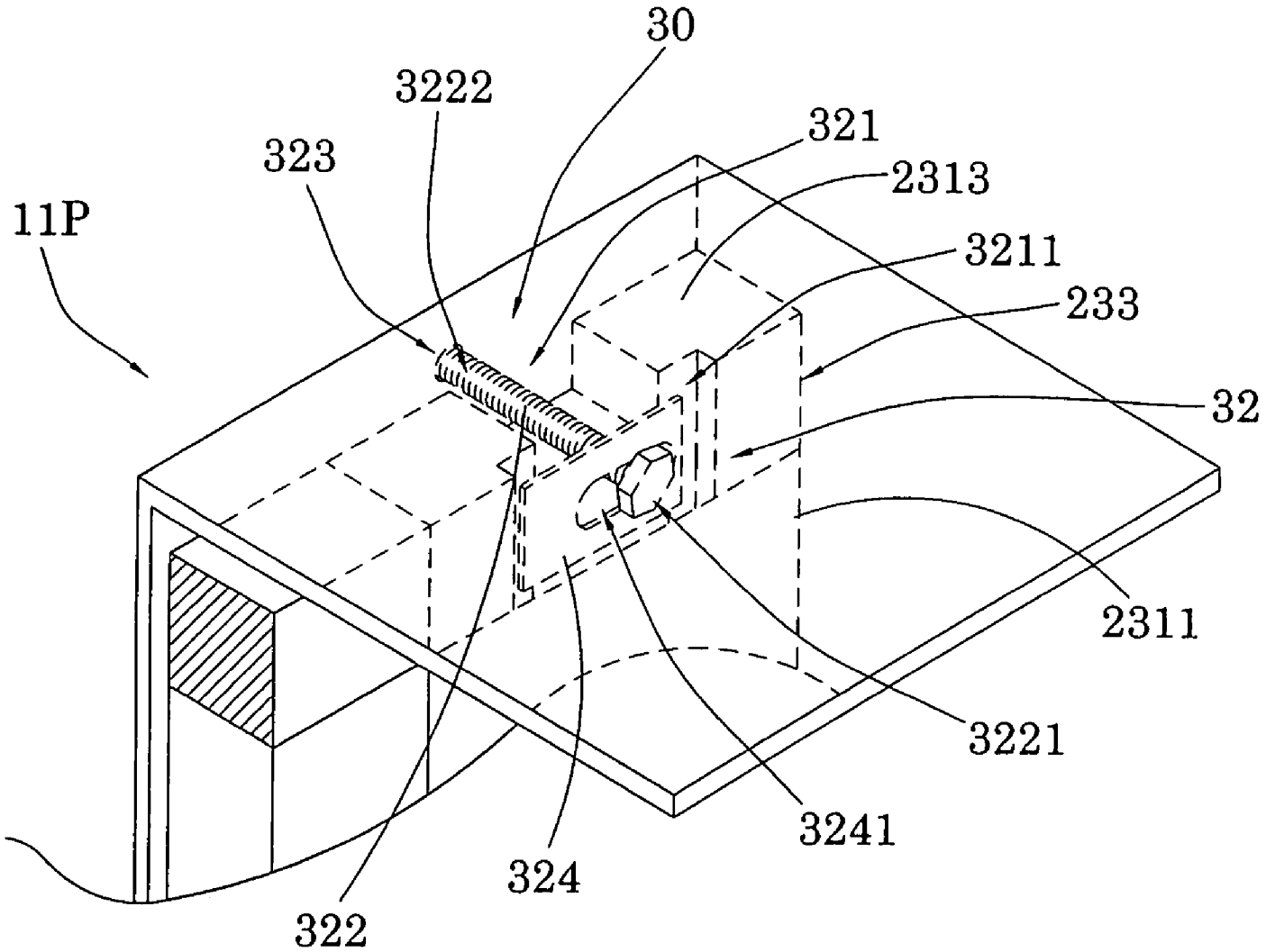
FIG. 3 is a partially perspective view of a portable work and storage container according to a preferred embodiment of the present invention.
Figure 4:
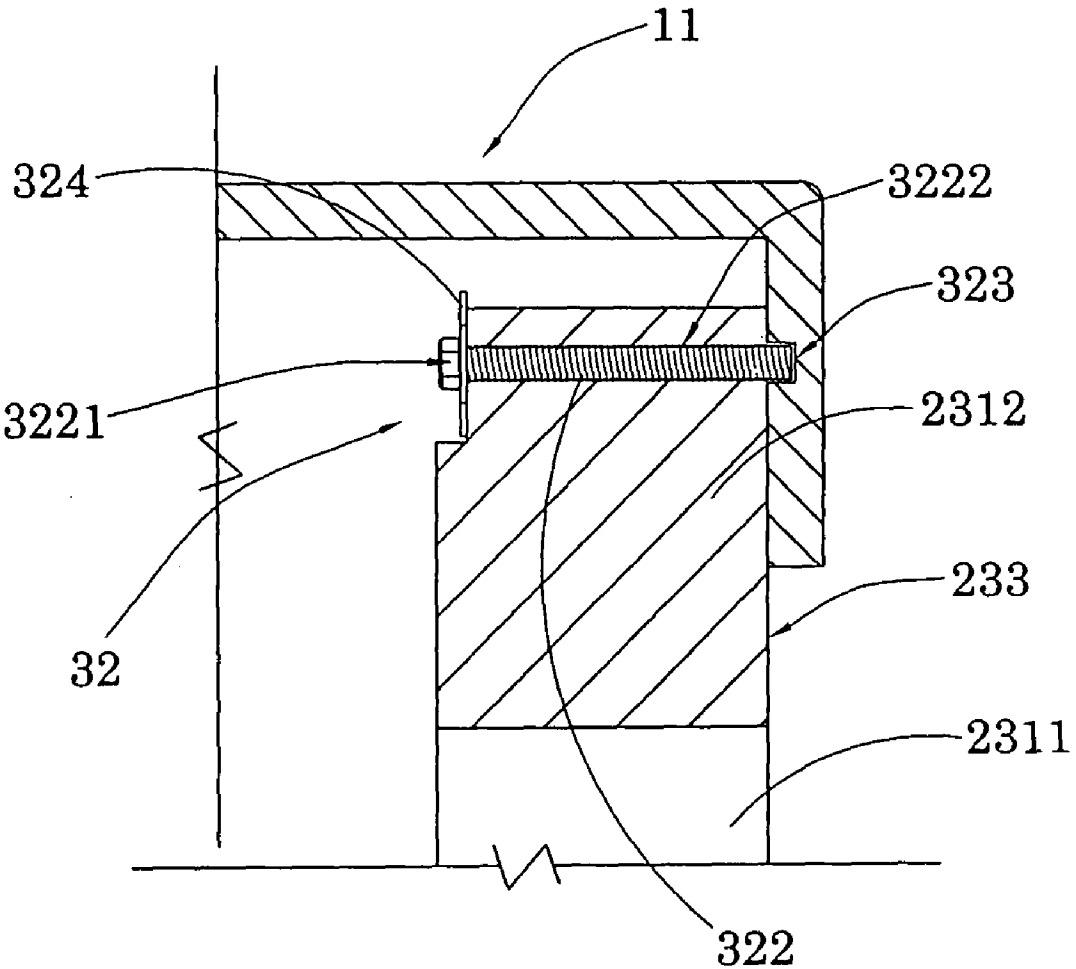
FIG. 4 is a sectional side view of the portable work and storage container according to the above preferred embodiment of the present invention.

Referring to FIG. 3 to FIG. 4 of the drawings, each of the wall lockers 32 has a coupling slot 321 provided at the top rim 233 of the wall structure 23 and comprises a locking member 322 extended through the coupling slot 321 of the wall structure 23 to releasably lock at the ceiling frame 11 so as to lock up the top rim 233 of the wall structure 23 at the ceiling frame 11. Each of the locking members 322 comprises an enlarged locking head 3221 biasing against an inner side of the top rim 233 of the wall structure 23, and an elongated locking body 3222 extended through the coupling slot 321 to releasably engage with the ceiling frame 11.

More specifically, each of the wall lockers 32 further contains a locking hole 323 formed at the ceiling frame 11 to align with the coupling slot 321 such that the respective locking member 322 is extended through the coupling slot 321 to engage with the locking hole 323. As such, the locking member 322 is arranged to securely fasten with the ceiling frame 11 so as to effectively restrict any collateral movement between the wall structures 23 and the container frame 10 through the use of the wall lockers 32.

Moreover, each of the wall lockers 32 further comprises a retention panel 324, having an elongated through slot 3241, substantially biasing against the inner side of the top rim 233 of the wall structure 23, wherein the locking head 3221 of the locking member 322 is biased against the retention panel 324 while the locking body 3222 of the locking member 322 is extended through the through slot 3241 to engage with the ceiling frame 11. Thus, the coupling slot 321 is extended from a top edge of the respective wall structure 23 and has a retention seat 3211 indently formed at the inner side of the top rim 233 to receive the retention panel 324 at the retention seat 3211.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A portable work and storage container, comprising:

a container frame which comprises a ceiling frame, a floor frame and four vertical corner posts spacedly extended between said ceiling frame and said floor frame;

an enclosure arrangement which comprises a ceiling panel mounting at said ceiling frame, a floor panel mounting at said floor frame, and four wall structures mounting to said corner posts, each of said wall structures comprises a plurality of wall panels mounting between every two neighboring corner posts edge-to-edge to define a compartment within said ceiling panel, said floor panel, and said wall structures; and a wall panel affixing arrangement, which comprises:

a plurality of wall adjusters spacedly coupled at said corner posts respectively, wherein said wall adjusters are adjustably extended to bias against two outer side rims of said wall structure respectively for applying a pushing force along a longitudinally planar direction of said wall structure so as to ensure said wall panels of each of said wall structures are coupled with each other side-by-side; and a plurality of wall lockers spacedly coupled at said ceiling frame, wherein said wall lockers are adjustably engaged with top rims of said wall structures respectively to lock up said wall structures between said ceiling frame and said floor frame so as to securely retain said wall structures in a transversely planar direction.

2. The portable work and storage container, as recited in claim 1, wherein each of said wall adjusters comprises a retention panel extended from said respective corner post and an adjustable coupler rotatably coupling with said retention panel to press against said respective outer side rims of said wall structures in a longitudinally planar direction thereof.

3. The portable work and storage container, as recited in claim 2, wherein each of said adjustable couplers has an enlarged head end, an adjusting end, and an elongated threaded body extended between said head end and said adjusting end and arranged in such a manner that when said threaded body is adjustably rotated at said retention panel, said head end is adjustably moved to press against said respective outer side rim of said of said wall structure for applying said pushing force thereat.

4. The portable work and storage container, as recited in claim 3, wherein each of said retention panel, having a L-shaped cross section, has a first retention portion extended from said respective corner post to parallely extend with said respective wall structure, and a second retention portion perpendicularly extended from said first retention portion to align with said respective outer side rim of said wall structure, wherein said adjustable coupler is rotatably coupled with said second retention portion to press against said respective outer side rims of said wall structures in a longitudinally planar direction thereof.

5. The portable work and storage container, as recited in claim 4, wherein said second retention portion of each of said retention panels has a threaded hole rotatably engaging with said threaded body of said respective adjustable coupler to retain said adjustable coupler perpendicularly to said second retention portion of said retention panel in a rotatably movable manner.

6. The portable work and storage container, as recited in claim 5, wherein each of said corner posts has a L-shape structure as a wall converge for retaining two of said wall structures in a perpendicular manner at a corner of said container frame, wherein two or more of said wall adjusters are provided at each of said corner posts to adjustably engage with said outer side rims of said two wall structures.

7. The portable work and storage container, as recited in claim 1, wherein each of said wall lockers has a coupling slot provided at said top rim of said wall structure and comprises a locking member extended through said coupling slot of said wall structure to releasably lock at said ceiling frame so as to lock up said top rim of said wall structure at said ceiling frame.

8. The portable work and storage container, as recited in claim 6, wherein each of said wall lockers has a coupling slot provided at said top rim of said wall structure and comprises a locking member extended through said coupling slot of said wall structure to releasably lock at said ceiling frame so as to lock up said top rim of said wall structure at said ceiling frame.

9. The portable work and storage container, as recited in claim 7, wherein each of said locking members comprises an enlarged locking head biasing against an inner side of said top rim of said wall structure and an elongated locking body extended through said coupling slot to releasably engage with said ceiling frame.

10. The portable work and storage container, as recited in claim 8, wherein each of said locking members comprises an enlarged locking head biasing against an inner side of said top rim of said wall structure and an elongated locking body extended through said coupling slot to releasably engage with said ceiling frame.

11. The portable work and storage container, as recited in claim 9, wherein each of said wall lockers further contains a locking hole formed at said ceiling frame to align with said coupling slot such that said respective locking member is extended through said coupling slot to engage with said locking hole.

12. The portable work and storage container, as recited in claim 10, wherein each of said wall lockers further contains a locking hole formed at said ceiling frame to align with said coupling slot such that said respective locking member is extended through said coupling slot to engage with said locking hole.

13. The portable work and storage container, as recited in claim 11, wherein each of said wall lockers further comprises a retention panel, having an elongated through slot, substantially biasing against said inner side of said top rim of said wall structure, wherein said locking head of said locking member is biased against said retention panel while said locking body of said locking member is extended through said through slot to engage with said ceiling frame.

14. The portable work and storage container, as recited in claim 12, wherein each of said wall lockers further comprises a retention panel, having an elongated through slot, substantially biasing against said inner side of said top rim of said wall structure, wherein said locking head of said locking member is biased against said retention panel while said locking body of said locking member is extended through said through slot to engage with said ceiling frame.

15. The portable work and storage container, as recited in claim 13, wherein said coupling slot is extended from a top edge of said wall structure and has a retention seat indently formed at said inner side of said top rim to receive said retention panel at said retention seat.

16. The portable work and storage container, as recited in claim 14, wherein said coupling slot is extended from a top edge of said wall structure and has a retention seat indently formed at said inner side of said top rim to receive said retention panel at said retention seat.

17. The portable work and storage container, as recited in claim 15, wherein each of said wall panels comprises a panel body, a top brim extended along a top side of said panel body, and a bottom brim extended along a bottom side of said panel body, wherein said top rim of said structure is formed at said top brims of said panel bodies extending side-by-side.

18. The portable work and storage container, as recited in claim 16, wherein each of said wall panels comprises a panel body, a top brim extended along a top side of said panel body, and a bottom brim extended along a bottom side of said panel body, wherein said top rim of said structure is formed at said top brims of said panel bodies extending side-by-side.

19. A portable work and storage container, comprising:

a container frame which comprises a ceiling frame, a floor frame and four vertical corner posts spacedly extended between said ceiling frame and said floor frame;

an enclosure arrangement which comprises a ceiling panel mounting at said ceiling frame, a floor panel mounting at said floor frame, and four wall structures mounting to said corner posts, each of said wall structures comprises a plurality of wall panels mounting between every two neighboring corner posts edge-to-edge to define a compartment within said ceiling panel, said floor panel, and said wall structures; and a wall panel affixing arrangement, which comprises a plurality of wall adjusters spacedly coupled at said corner posts respectively, wherein said wall adjusters are adjustably extended to bias against two outer side rims of said wall structure respectively for applying a pushing force along a longitudinally planar direction of said wall structure so as to ensure said wall panels of each of said wall structure are coupled with each other side-by-side.

20. The portable work and storage container, as recited in claim 19, wherein each of said wall adjusters comprises a retention panel extended from said respective corner post and an adjustable coupler rotatably coupling with said retention panel to press against said respective outer side rim of said wall structure at longitudinally planar direction thereof.

21. The portable work and storage container, as recited in claim 20, wherein each of said adjustable couplers has an enlarged head end, an adjusting end, and an elongated threaded body extended between said head end and said adjusting end and arranged in such a manner that when said threaded body is adjustably rotated at said retention panel, said head end is adjustably moved to press against said respective outer side rim of said of said wall structure for applying said pushing force thereat.

22. The portable work and storage container, as recited in claim 21, wherein each of said retention panel, having a L-shaped cross section, has a first retention portion extended from said respective corner post to parallely extend with said respective wall structure, and a second retention portion perpendicularly extended from said first retention portion to align with said respective outer side rim of said wall structure, wherein said adjustable coupler is rotatably coupled with said second retention portion to press against said respective outer side rims of said wall structures in a longitudinally planar direction thereof.

23. The portable work and storage container, as recited in claim 22, wherein said second retention portion of each of said retention panels has a threaded hole rotatably engaging with said threaded body of said respective adjustable coupler to retain said adjustable coupler perpendicularly to said second retention portion of said retention panel in a rotatably movable manner.

24. The portable work and storage container, as recited in claim 23, wherein each of said corner posts has a L-shape structure as a wall converge for retaining two of said intersecting wall structures in a perpendicular manner, wherein two or more of said wall adjusters are provided at each of said corner posts to adjustably engage with said outer side rims of said two intersecting wall structures.

25. A portable work and storage container, comprising:

a container frame which comprises a ceiling frame, a floor frame and four vertical corner posts spacedly extended between said ceiling frame and said floor frame;

an enclosure arrangement which comprises a ceiling panel mounting at said ceiling frame, a floor panel mounting at said floor frame, and four wall structures mounting to said corner posts, each of said wall structures comprises a plurality of wall panels mounting between every two neighboring corner posts edge-to-edge to define a compartment within said ceiling panel, said floor panel, and said wall structures; and a wall panel affixing arrangement, which comprises a plurality of wall lockers spacedly coupled at said ceiling frame, wherein said wall lockers are adjustably engaged with top rims of said wall structures respectively to lock up said wall structures between said ceiling frame and said floor frame so as to securely retain said wall structures in a transversely planar direction.

26. The portable work and storage container, as recited in claim 25, wherein each of said wall lockers has a coupling slot provided at said top rim of said wall structure and comprises a locking member extended through said coupling slot of said wall structure to releasably lock at said ceiling frame so as to lock up said top rim of said wall structure at said ceiling frame.

27. The portable work and storage container, as recited in claim 26, wherein each of said locking members comprises an enlarged locking head biasing against an outer side of said top rim of said wall structure and an elongated locking body extended through said coupling slot to releasably engage with said ceiling frame.

28. The portable work and storage container, as recited in claim 27, wherein each of said wall lockers further contains a locking hole formed at said ceiling frame to align with said coupling slot such that said respective locking member is extended through said coupling slot to engage with said locking hole.

29. The portable work and storage container, as recited in claim 28, wherein each of said wall lockers further comprises a retention panel, having an elongated through slot, substantially biasing against said inner side of said top rim of said wall structure, wherein said locking head of said locking member is biased against said retention panel while said locking body of said locking member is extended through said through slot to engage with said ceiling frame.

30. The portable work and storage container, as recited in claim 29, wherein said coupling slot is extended from a top edge of said wall structure and has a retention seat indently formed at said inner side of said top rim to receive said retention panel at said retention seat.

31. The portable work and storage container, as recited in claim 30, wherein each of said wall panels comprises a panel body, a top brim extended along a top side of said panel body, and a bottom brim extended along a bottom side of said panel body, wherein said top rim of said structure is formed at said top brims of said panel bodies extending side-by-side.

* * * * *